United States Patent [19]

Follert

[11] 4,049,317

[45] Sept. 20, 1977

[54] TUNNEL DRIVING APPARATUS

[75] Inventor: Hans Günter Follert, Dortmund, Germany

[73] Assignee: Gewerkschaft Eisenhutte Westfalia, Westphalia, Germany

[21] Appl. No.: 651,613

[22] Filed: Jan. 22, 1976

[30] Foreign Application Priority Data

Feb. 3, 1975 Germany ..... 2504370

[51] Int. Cl.[2] ..... E01G 3/04

[52] U.S. Cl. ..... 299/33; 61/42; 61/84

[58] Field of Search ..... 61/84, 85, 42, 45 R; 299/31, 33, 55, 56, 60; 175/61, 73

[56] References Cited

U.S. PATENT DOCUMENTS

| | | | |
|---|---|---|---|
| 3,506,310 | 4/1970 | Gruere | 299/56 |
| 3,556,599 | 1/1971 | Fikse | 299/33 X |
| 3,650,116 | 3/1972 | Cunningham | 61/85 |
| 3,828,862 | 8/1974 | Dabell et al. | 299/33 X |
| 3,861,750 | 1/1975 | Follert et al. | 299/33 |

FOREIGN PATENT DOCUMENTS

| | | | |
|---|---|---|---|
| 1,025,808 | 3/1958 | Germany | 299/33 |
| 1,934,991 | 1/1971 | Germany | 299/33 |

*Primary Examiner*—Dennis L. Taylor
*Attorney, Agent, or Firm*—Thompson, Birch, Gauthier & Samuels

[57] ABSTRACT

A tunnel driving apparatus employs a cutting head supported by an undercarriage disposed within a hollow shield. The undercarriage is slidably suspended on elongated support arms which are pivoted to rocker arms which in turn are also pivoted to the shield. The support arms and rocker arms are raisable and lowerable at their rear ends with the aid of piston and cylinder units. Pivoting of the support arms serves to alter the angular disposition of the cutting head and pivoting of the rocker arms serves to displace the pivotal axis of the support arms to vary the height of the cutting head.

11 Claims, 4 Drawing Figures

TUNNEL DRIVING APPARATUS

BACKGROUND TO THE INVENTION

The present invention relates to apparatus for driving tunnels, galleries, roadways or similar underground excavations and hereinafter referred to as tunnel-driving apparatus.

Various types of tunnel driving apparatuses are known which employ a cutting appliance or head mounted at the front end of a support shield and serving to detach material from a working face. In many cases there is a need for a mounting system which permits the cutting head to be adjusted to an inclined position and hitherto it has been known to permit the cutting head to pivot about an axis extending across the tunnel. There is a need however for an improved mounting system for the cutting head and a general object of this invention is accordingly to provide an improved form of apparatus.

SUMMARY OF THE INVENTION

In its broadest aspect the invention provides a tunnel driving apparatus which employs a cutting head for detaching material to permit advancement or driving of the tunnel and means for supporting the cutting head in an operative position, the support means being pivotable about an axis extending generally transversally of the tunnel driving direction and adjustable in position within a vertical plane.

The invention also provides a tunnel driving apparatus comprising a cutting head for detaching material from a working face to effect driving of the tunnel, an undercarriage serving as means for supporting the cutting head, means for pivotably supporting the undercarriage to permit the undercarriage to pivot about an axis extending generally transversally of the tunnel driving direction and means for selectively adjusting the vertical position of said pivot axis. Normally the undercarriage or support means would be at least partly located in a support shield, as known per se.

By providing for vertical adjustment of the pivot axis of the support means or undercarriage the cutting head has a greater freedom of movement than hitherto. This enables adjustments to be made to compensate for changes such as the wear of the cutting tools of the cutting head and moreover permits superior operative adjustment of the cutting profile performed by the head.

In accordance with the invention the means permitting such adjustments can be so designed as to be relatively compact and reliable.

In a preferred simple construction the adjustment of the vertical positions of said pivot axis involves pivoting of said axis about a further axis parallel to said axis. This further axis can be conveniently located above the main or first-mentioned axis and forwardly therefrom, towards the cutting head. The main axis may be defined by one or more pivot pins located on one or more cranked rocker arms, the or each arm being pivotable on a joint defining the further axis. Preferably two such rocker arms symmetrically positioned would be used. Pivoting of these rocker arms and of the undercarriage can be achieved by hydraulic piston and cylinder units which thus serve to tilt the cutting head and to adjust its vertical disposition. Under various working conditions the units can be operated to maintain the cutting head in any desired operating position.

In a preferred construction the undercarriage is slidably suspended on support arms pivoted on the pins located on the rocker arms. The undercarriage can thus be displaced along the support arms. The support arms can engage in guide channels provided at the sides of the undercarriage. The piston and cylinder units effecting pivoting of the support arms, and hence of the undercarriage, and the rocker arms can be connected between the shield and the rear ends of the support arms and rocker arms preferably projecting rearwardly beyond the undercarriage. By making the rocker arms and support arms of adequate length a fine adjustment of the cutting head can be achieved with a comparatively small force. Preferably the pivot pins are mounted to upwardly inclined front portions of the rocker arms which are pivoted to the joints near their ends.

The undercarriage can conveniently be of U-shaped cross-section with a base wall, carrying a drive means for the cutting head, and side walls provided externally with the guide channels receiving support arms. The support arms and rocker arms can thus lie laterally outside the undercarriage.

In one preferred form an apparatus made in accordance with the present invention comprises a tunnel driving apparatus comprising a cutting head for detaching material from a working face to permit driving or advancement of the tunnel, an undercarriage supporting the cutting head, the undercarriage being at least partly disposed within a support shield, support arms slidably suspending the undercarriage to permit the undercarriage to be displaced in the tunnel driving direction, pivot pins joints offset from said pivot pins and pivotably mounting the rocker arms to said shield means for pivoting the arms about the pins to tilt the undercarriage and cutting head and means for pivoting the rocker arms about the joints to displace the pivot pins in a vertical sense to adjust the height of the cutting head.

The invention may be understood more readily and various other features of the invention may become apparent from consideration of the following description.

BRIEF DESCRIPTION OF DRAWINGS

An embodiment of the invention will now be described, by way of example only, with reference to the accompanying drawing, wherein.

DESCRIPTION OF PREFERRED EMBODIMENT.

Figure 3:
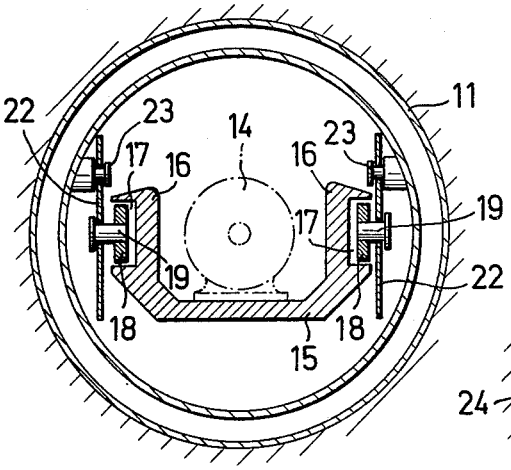
FIG. 3 is a schematic cross-sectional view of the apparatus shown in FIG. 1, the view being taken along the line III—III of FIG. 1.
Figure 4:
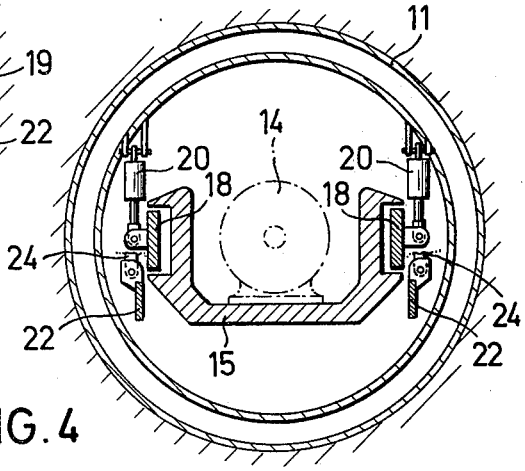
FIG. 4 is a further schematic cross-sectional view of the apparatus shown in FIG. 1, the view being taken along the line IV—IV of FIG. 1.

As shown in the drawing, a tunnelling apparatus is installed in an underground excavation or tunnel which in this case is depicted as having a circular cross-section. The apparatus employs a shield or casing 11, which is of hollow double-walled construction, supporting the tunnel wall. The shield 11 has a knife-edge 13 at its forward end and a cutting head 12 is mounted in front of this to attack a working face 10 and permit advancement of the tunnel in known manner. The cutting head 12 is supported by support means in the form of an elongate movable undercarriage 15 which also supports a drive means 14 for driving the cutting head 12. As shown in FIG. 3, this undercarriage 15 has a generally U-shaped cross-section with a base wall supporting the drive means 14 and adjoining side walls 16. On the opposite outer sides of the walls 16 there are guide channels 17 extending longitudinally of the shield 11. These guide channels receive longitudinal support arms 18 so that the undercarriage 15 and hence the drive means 14 and the cutting head 12 are slidably suspended on these guide bars 18. The body 15 can be displaced along the support arms 18 to move the cutting head 12 into or out from the shield 11 with the aid of one or more double-acting hydraulic rams (not shown).

Figure 1:
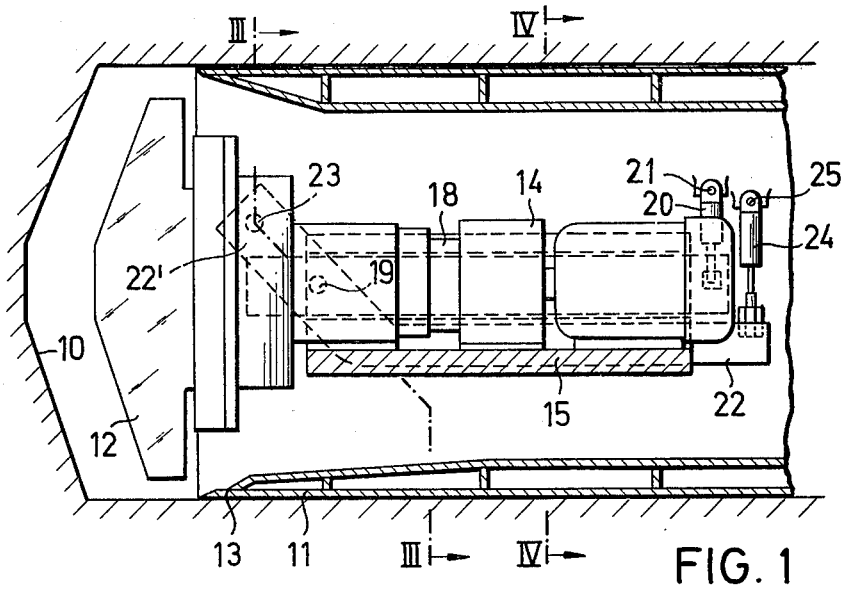
FIG. 1 is a schematic part-sectional side view of one form of apparatus made in accordance with the invention.

The support arms 18 are themselves supported on second pivot means comprising pivot pins 19 having horizontal colinear pivot axes extending tranversally of the longitudinal axis of the shield 11. Thus the undercarriage support means for the cutting head 12 can pivot on these pins 19. The pins 19, which are located at the forward region of the drive means 14, are each mounted on an inclined front portion 22' (FIG. 1) of a rocker arm 22. These arms 22 each have a rear portion extending generally parallel to the support arms 18 and beneath the latter. The front portions 22' of the arms 22 are pivotably connected at first pivot means comprising joints 23 to a mounting piece rigidly fixed to the inside of the shield 11. The pivot joints 23 are located above the pins 19. The rear end portions of the arms 22 are each connected to the piston rod of first ram means 20 comprising a hydraulic piston and cylinder unit having its cylinder pivotably suspended, as at 25, from lugs or brackets provided on the inside of the shield 11. Similarly, the rear ends of the support arms 18 are each connected to the piston rod of second rams means 20 comprising a hydraulic piston and cylinder unit having its cylinder pivotably suspended, as at 21, from further lugs or brackets provided on the inside of the shield 11. The rear ends of the rocker arms 22 and the support arms 18 are located outwardly beyond the rear end of the drive means 14.

Figure 2:
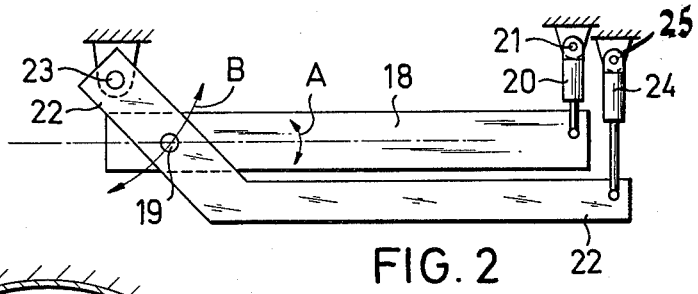
FIG. 2 is a schematic side view of part of the apparatus shown in FIG. 1.

As will now be described the ram means 20, 24 enable the undercarriage 15 and hence the cutting head 12 to be adjusted in position. In a normal position, depicted in FIG. 2, the support arms 18 can be arranged with their longitudinal axes parallel to and aligned horizontally with, the longitudinal axis of the shield 11. Extension or retraction of the ram means 20 enable the support arms 18 to pivot on the pins 19 to swing their axes into inclined position as represented by arrow A in FIG. 2. Since the drive means 15 is suspended from the support arms 18, the body 15 and the cutting head 12 will perform a corresponding tilting movement. Extension or retraction of the units 24 enable the arms 22 to pivot on the joints 23 so that the pins 19 are displaced about the joints 23 as represented by arrow B in FIG. 2. In this way the pins 19 can be displaced in a vertical plane and this in turn enables the height of the cutting head 12 to be adjusted. When the cutting head 12 is adjusted to the desired height the arms 22 can remain in position to maintain this height and thereafter pivoting of the bars 18 can occur on the positionally-fixed pins 19.

Because the rocker arms 22 and the support arms 18 are comparatively long a relatively small force provided by the units 20, 24 will suffice to adjust the cutting head.

I claim:

1. In a tunnel driving apparatus including a hollow tubular protective shield and a cutting head mounted on a movable undercarriage within the protective shield for detaching material from a mine working face to effect driving of a tunnel, improved means for supporting and for selectively positioning the undercarriage, said improved means comprising:

a. rocker arm means extending longitudinally within the hollow protective shield, said rocker arm means being pivotally attached near its front end to the protective shield by a transversely extending first pivot means;

b. first ram means pivotally attached at one of its end to the protective shield and pivotally attached at the other of its ends near the rear end of said rocker arm means, said first ram means being selectively actuated to pivot said rocker arm means about the transversely extending first pivot means;

c. longitudinal support means for mouting the undercarriage for slidable movement thereon, said longitudinal support means extending longitudinally within the hollow protective shield and being pivotally attached near its front end to said rocker arm means by a transversely extending second pivot means.

d. second ram means pivotally attached at one of its ends to the protective shield and pivotally attached at the other ot its ends near the rear end of said longitudinal support means, said second ram means being selectively actuated to pivot said longitudinal support means about the transversely extending second pivot means;

e. said first ram means actuation raising and lowering the transversely extending axis of the second pivot means relative to the longitudinal axis of the protective shield; and f. said second ram means actuation angularly altering the angle of the longitudinal axis of the cutting head relative to the longitudinal axis of the protective shield.

2. Apparatus of claim 1 wherein the front end portion of said rocker arm means extends angularly upwardly and forwardly relative to the longitudinal axis of the protective shield, and the rear end portion of said rocker arm means extends parallel to the longitudinal axis of the protective shield.

3. Apparatus of claim 1 wherein said rocker arm means comprises two parallel, spaced-apart transversely aligned rocker arms.

4. Apparatus of claim 1 wherein said longitudinal support means comprises two straight, parallel, spaced-apart, transversely aligned longitudinal support arms.

5. Apparatus of claim 1 wherein the transversely extending axis of the second pivot means intersects with the longitudinal axis of the cutting head.

6. Apparatus of claim 1 wherein the transverse extending axis of the second pivot means extends below the transversely extending axis of the first pivot means relative to the longitudinal axis of the protective shield.

7. Apparatus of claim 1 wherein the transversely extending axis of the second pivot means extends to the rear of the transversely extending axis of the first pivot means relative to the longitudinal axis of the protective shield.

8. Apparatus of claim 7 wherein the transversely extending axis of the second pivot means extends below the transversely extending axis of the first pivot means relative to the longitudinal axis of the protective shield.

9. Apparatus of claim 1 wherein said first and second ram means are located to the rear of said first and second pivot means relative to the longitudinal axis of the protective shield.

10. Apparatus of claim 4 wherein the undercarriage is U-shaped and is positioned between and slidably engages said longitudinal support arms.

11. Apparatus for driving tunnels or similar underground excavations; said apparatus comprising a body carrying cutting means, guide means slidably guiding the body for movement generally parallel to the driving direction and at about the central axis of the tunnel and means pivotably suspending the guide means for pivoting about first and second distal axes extending laterally of the tunnel, wherein the suspension means comprises cranked arms mounted for pivoting about said first axis and the guide means comprises elongate guide arms mounted to the cranked arms for pivoting about said second axis and wherein there is further provided means for raising and lowering the rear ends of the cranked arms and the guide arms relative to the driving direction to control the operating position of the cutting means.

* * * * *